US006997858B1

(12) United States Patent
Moravek

(10) Patent No.: US 6,997,858 B1
(45) Date of Patent: Feb. 14, 2006

(54) SIDE GUSSETED POLY BAG WITH A FILLING VALVE AND ITS METHOD OF MANUFACTURE

(76) Inventor: Lawrence R. Moravek, 100 W. Roosevelt Rd., Building B-8, Suite 103A, Wheaton, IL (US) 60187

( * ) Notice: Subject to any disclaimer, the term of this patent is extended or adjusted under 35 U.S.C. 154(b) by 15 days.

(21) Appl. No.: 10/714,240

(22) Filed: Nov. 13, 2003

(51) Int. Cl.
*B31B 1/90* (2006.01)

(52) U.S. Cl. ..... 493/212; 493/213

(58) Field of Classification Search ..... 493/212, 493/213; 53/412
See application file for complete search history.

(56) References Cited

U.S. PATENT DOCUMENTS

| | | | | |
|---|---|---|---|---|
| 3,894,683 | A * | 7/1975 | Henderson | 383/50 |
| 4,071,187 | A * | 1/1978 | LaFleur | 383/45 |
| 4,881,825 | A * | 11/1989 | Olesen | 383/50 |
| 5,165,799 | A * | 11/1992 | Wood | 383/8 |
| 5,366,295 | A * | 11/1994 | Montesissa et al. | 383/201 |
| 6,572,268 | B1 * | 6/2003 | Ichikawa | 383/120 |

* cited by examiner

*Primary Examiner*—Eugene Kim
(74) *Attorney, Agent, or Firm*—Dillis V. Allen, Esq.

(57) ABSTRACT

A side gusseted poly bag with a filling valve and its method of manufacture including a tubular body with opposed side gussets defining front and rear panels, and a filling valve formed by folding the front and rear panels with the interconnecting gusset portion at one corner of the bag inwardly into the bag forming a filling panel, and simultaneously heat sealing the top edges of the front and rear panels with the top edges of the filling panel forming a filling tube and valve that closes itself under the force of material as it rises in the bag.

7 Claims, 6 Drawing Sheets

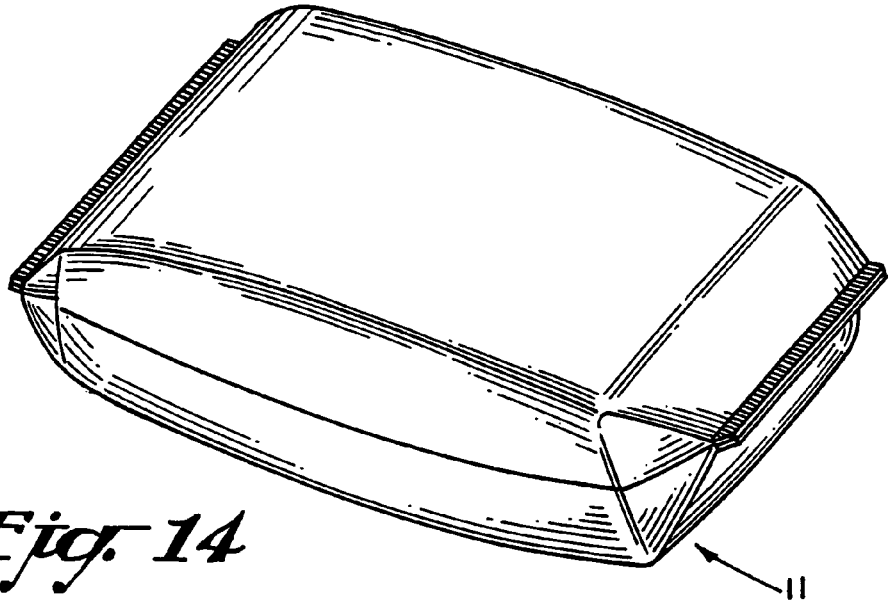
Fig. 14
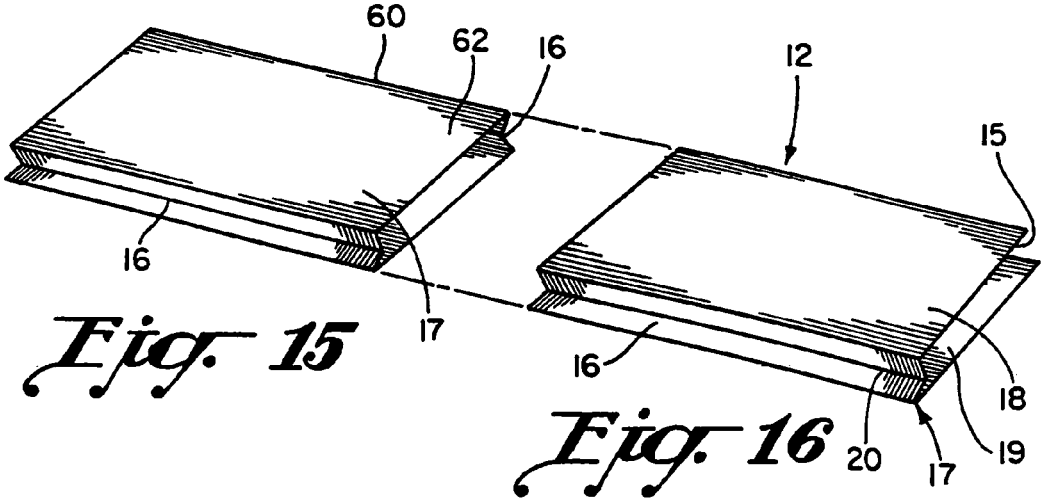
Fig. 15
Fig. 16
Fig. 17
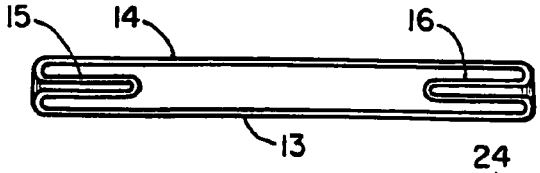
Fig. 18
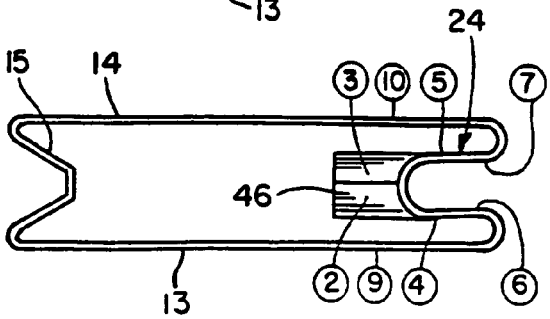

SIDE GUSSETED POLY BAG WITH A FILLING VALVE AND ITS METHOD OF MANUFACTURE

BACKGROUND OF THE INVENTION

Side gusseted paper bags have been commercially made for many years with openings that permit bag charging or filling. But these bags are quite costly, not only because of the additional materials needed about the bag filling opening, but also because of the labor and time to close and seal the bag.

The following patents were found in a preliminary patentability search:

| Inventor | U.S. Pat. No. | Issue Date |
|---|---|---|
| Harvey | 3,276,670 | Jul. 27, 1964 |
| Piazze | 3,618,478 | Nov. 9, 1971 |
| Benoit | 4,571,235 | Feb. 18, 1986 |
| Benoit | 4,655,737 | Apr. 7, 1987 |
| Roen, et al. | 4,717,262 | Jan. 5, 1988 |
| Humphrey | 4,764,030 | Aug. 16, 1988 |
| Benoit | 4,816,104 | Mar. 28, 1989 |
| Olesen | 4,881,825 | Nov. 21, 1989 |
| Beer | 4,913,561 | Apr. 3, 1990 |
| Gelbard | 4,943,167 | Jul. 24, 1990 |
| Mundus | 4,959,114 | Sep. 25, 1990 |
| Wood | 5,165,799 | Nov. 24, 1992 |
| Gebhardt | 5,676,467 | Oct. 14, 1997 |
| Schoeler | 5,862,652 | Jan. 26, 1999 |
| Daniels, et al. | Re.36,876 | Sep. 19, 2000 |
| Beer | 6,213,645 | Apr. 10, 2001 |
| Angless | 6,254,520 | Jul. 3, 2001 |

The Harvey, U.S. Pat. No. 3,276,670, shows a tapered side gusseted bag but has no filling valve. The Piazze, U.S. Pat. No. 3,618,478, shows a gusseted bottom bag with diagonal heat seals but has no filling valve either.

The Benoit, U.S. Pat. Nos. 4,571,235 and 4,816,104, show a T-shirt bag with diagonal heat seals at the bottom. Again, it has no filling valve. The Benoit, U.S. Pat. No. 4,655,737, is duplicative with respect to the Benoit '235 patent.

The Roen, et al., U.S. Pat. No. 4,717,262, shows a gusseted bottom bag with diagonal heat seals and a sine wave handle. The Humphrey, U.S. Pat. No. 4,764,030, shows serrated bags on a roll but no discharge or filling valve.

The Olesen, U.S. Pat. No. 4,881,825, discusses both a filling valve and a discharge valve and a "block" style bottom and top, formed by folding and overlapping the ends of an open tube onto itself much like gift wrapping a box but tucking the sides inwardly and then folding the paper onto itself. See FIG. 10, for example. The discharge valve is for the purpose of pouring product out of the bag and no details are shown of the charging features in Olesen's bag.

The Beer, U.S. Pat. No. 4,913,561, shows what appears to be a valve on the upper left corner of the bag but rather than that, it is a heat seal which is intended to allow the bag to square once it is filled with product.

The Gelbard, U.S. Pat. No. 4,943,167, shows a side gusseted T-shirt bag made three across at one time and involves the continuous slitting and heat sealing of one tube longitudinally into three longitudinal tubes, post gusseting and heat sealing to create a top and bottom of the bag.

The Mundus, U.S. Pat. No. 4,959,114, shows a method which includes feeding flat sheet roll stock, folding it over into two, post gusseting it and sealing it into gusseted tubing with a longitudinal heat seal and then trimming off the excess.

The Wood, U.S. Pat. No. 5,165,799; the Gebhardt, U.S. Pat. No. 5,676,467; the Schoeler, U.S. Pat. No. 5,862,652; the Daniels, et al., Re.36,876; the Beer, U.S. Pat. No. 6,213,645; the Angless, U.S. Pat. No. 6,254,520; the Totani, Pub. U.S. 2001/0002938, published Jul. 7, 2001; and the Interpoly Limited U.K. Patent Application GB 2 226 541A, published Apr. 7, 1990, all show gusseted bags, gusseted T-shirt bags, laminated film structure gusseted bags, tri-folded bags, post-bag making, and a separate bottom panel system sealed into a tube on four sides that shows an accordion type bag. None of these latter patents have filling systems.

It is a primary object of the present invention to ameliorate the problems noted above in prior art chargeable bags.

SUMMARY OF THE PRESENT INVENTION

In accordance with the present invention, a side gusseted poly bag with a filling valve and its method of manufacture are provided including a tubular body with opposed side gussets defining front and rear panels, and a filling valve formed by folding the front and rear panels with the interconnecting gusset portion at one corner of the bag inwardly into the bag forming a filling panel, and thereafter simultaneously heat sealing the top edges of the front and rear panels with the top edges of the filling panel forming a filling tube and valve that closes itself under the force of material as it rises in the bag.

Considerable material savings are achieved by utilizing portions of the front and rear panels and interconnecting gusset portion to form portions of the filling tube. The remaining portions of the filling tube are formed by an "L" shaped integral extension of the front and rear panels and their interconnecting gusset. Alternatively, the extension portions could be a separate piece of material heat sealed to the upper edges of the panels and gusset at the corner. The integral extension embodiment has some material waste because it extends only about 30% of the width of the gusseted web in manufacture. But it saves labor because there is no heat sealing of the separate piece to the preform, which is an additional step. On the other hand, the separate piece method, while requiring an additional step, has no material waste. Either embodiment may be best for a particular application, but the integral extension embodiment is preferred and the one depicted in the present drawings.

Because the filling tube is connected completely around the filling opening, which is diagonally oriented, the rise of material in the bag very effectively closes the filling tube over the opening thereby sealing the bag with no further effort.

BRIEF DESCRIPTION OF THE DRAWINGS

FIG. 14 is a perspective view of a filled bag;

FIGS. 15 and 16 are depictions of a tubular web being fed and cut according to the present method;

FIG. 17 is a cross-section taken through line 17—17 of FIG. 3; and, FIG. 18 is a cross-section along line 12—12 of FIG. 2, showing the bottom of the filling tube and the gusset including panels 4 and 5.

DETAILED DESCRIPTION OF THE PREFERRED EMBODIMENT

Figure 1:
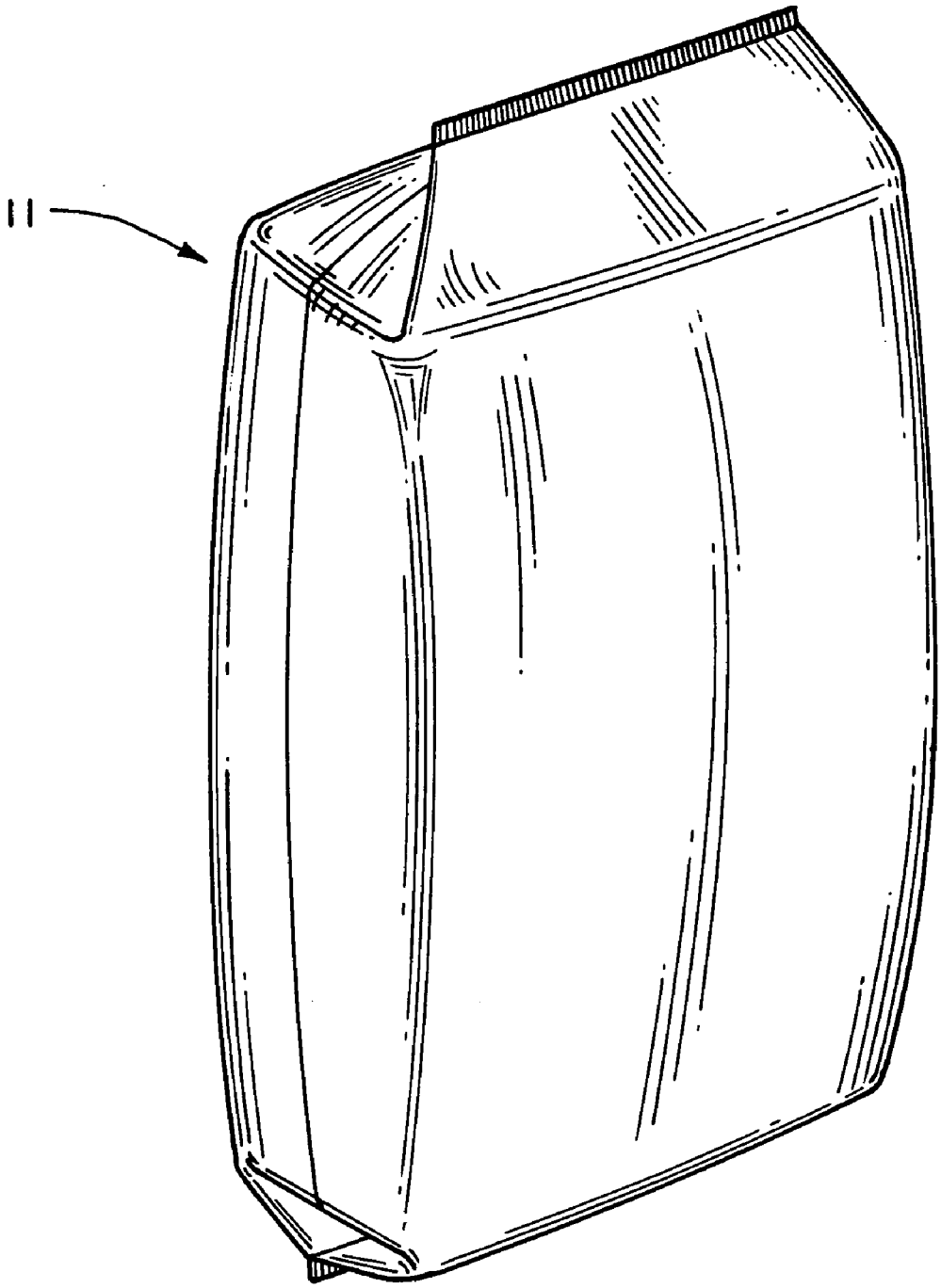
FIG. 1 is a perspective view of the present gusseted poly bag filled with material.

Referring to the drawings, and particularly FIGS. 1 to 10, a side gusseted poly bag 11 is illustrated constructed of a thin tubular thermoplastic material having a thickness on the order of 3 to 6 mils. At the outset, it should be noted because of the visual complexity of understanding the various folds in constructing the present bag 11, that various panels that are defined by fold lines have been illustrated in the drawings with encircled numbers such as those shown in FIGS. 6, 7, 8, and 9. Each of these panels is defined by a plurality of enclosed fold lines and permit the reader to follow the sequence of folding from FIG. 6 to FIGS. 12 and 13. These encircled numbers are not to be confused with the uncircled reference numerals in the various Figures.

Figure 5:
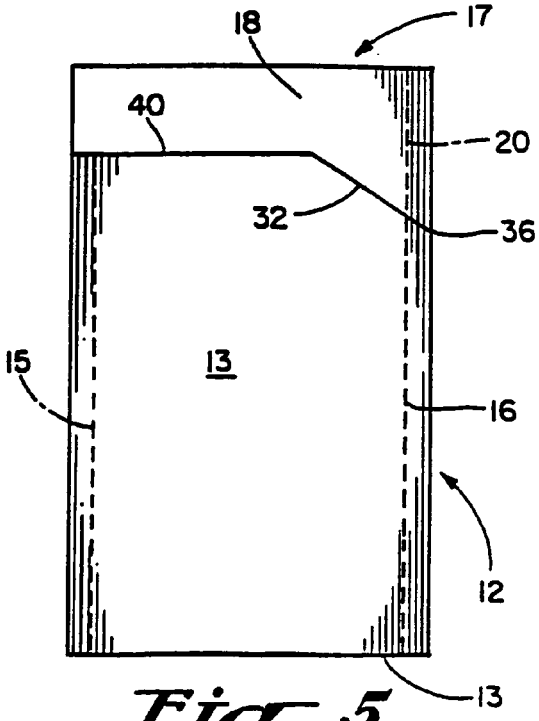
FIG. 5 is a front view of the bag preform showing the proportional sizes of the L-shaped preform extension.

It should be understood that the perspective view of FIG. 1 represents a filled container. As seen in FIG. 5 initially, which illustrates a preform 12 of the present container, it is seen to include a front panel 13, a rear panel 14 shown in FIG. 2, and side gussets 15 and 16, and an upward extension 17 that includes a front panel portion 18, a rear panel portion 19 shown in FIG. 16, and a side gusset portion 20 shown in both FIGS. 5 and 16.

Figure 2:
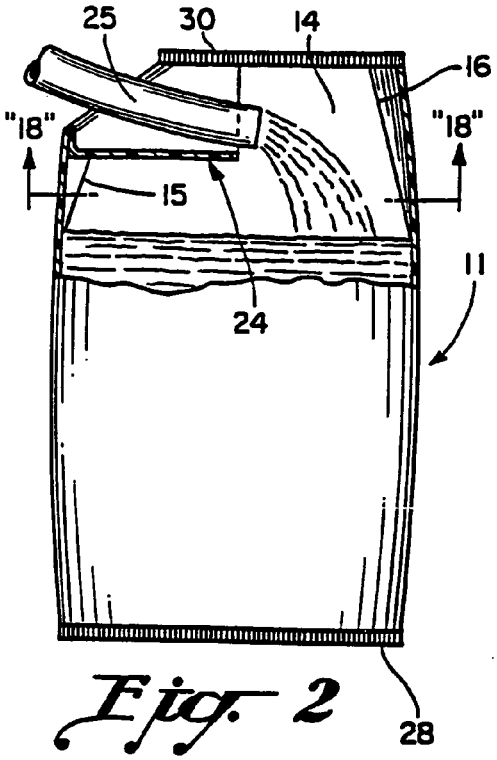
FIG. 2 is a plan view of a partly filled poly bag with a filling tube inserted into the valve, discharging material into the bag.
Figure 4:
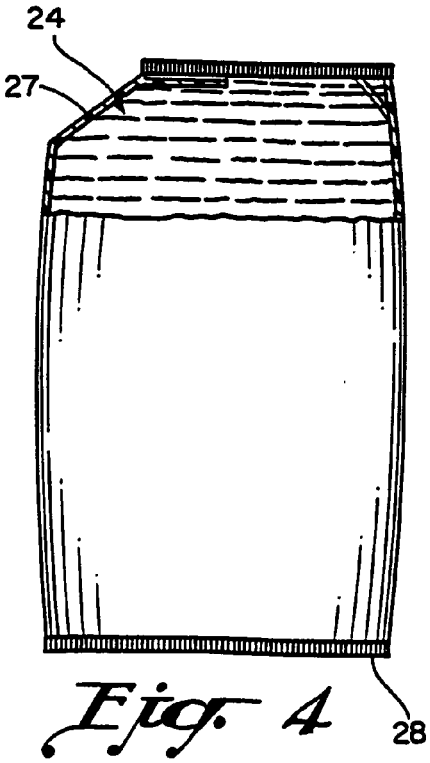
FIG. 4 is a partly fragmented view of the bag similar to FIGS. 2 and 3, illustrating the sealing of the filling opening.

The extension 17, when properly folded and heat sealed, becomes the tubular valve 24 shown in FIGS. 2 and 4. Valve 24 is a filling tube and valve which receives a material discharge tube 25 shown inserted into the valve in FIG. 2 for charging the poly bag 11 with various materials. As will appear more clearly hereinafter as the bag fills, the tube 24 collapses against bag filling opening 27, as shown in FIG. 4.

Figure 3:
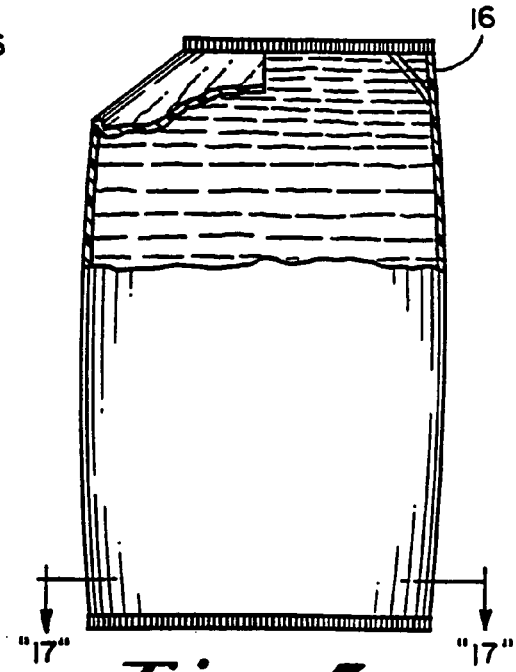
FIG. 3 is a partly fragmented view similar to FIG. 2, with the bag completely filled.

The bottom of the bag is heat sealed at 28, as shown in FIGS. 2 to 4, and that heat seal includes not only the front and back panels 13 and 14, as shown in FIG. 17, but also the side gussets 15 and 16, also shown in FIG. 17. The top of the bag is heat sealed at 30, which includes not only the front panel 13 and rear panel 14, as shown in FIG. 18, but also the upper edges of the gusset 15 and the upper edges of the valve 24, as seen in FIG. 18 so that the entire upper configuration of the bag 11 is heat sealed together in a single heat seal 13.

Figure 6:
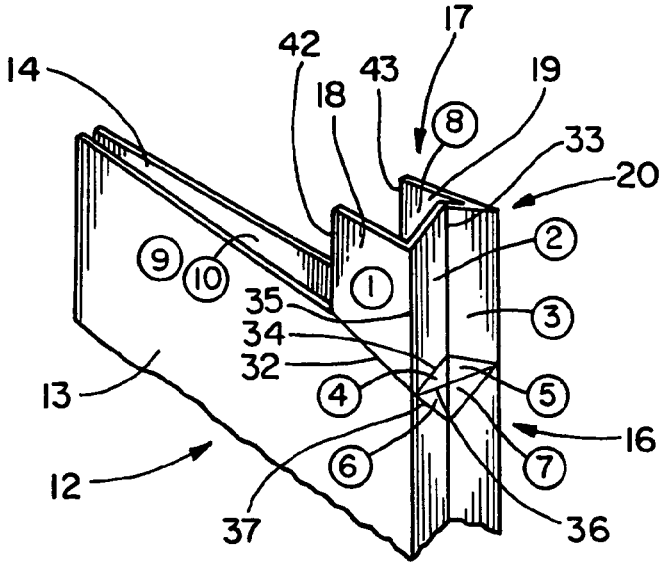
FIG. 6 is a perspective fragmentary view of the preform illustrated in FIG. 5, with the bag partly expanded and the relevant panels making up the valve being numbered from 1 to 8, and the front and rear panels being numbered 9 and 10 respectively.

FIG. 6 illustrates the preform 12 in FIG. 5 with the various panels numbered and encircled to achieve an understanding of the folding and formation of the valve 24. Panel 9 circled is simply front panel 13 and panel 10 circled is rear panel 14. Panel portion 1 circled is the front panel portion 18 and panel 8 circled is the rear panel portion 19. Panel portion 1 circled is defined by a diagonal fold line 32 and rear panel 19 is defined by a co-linear unnumbered fold line. Panel 2 circled is defined by vertical gusset line 33 and fold lines 34 and 35. Triangular panel 4 circled is defined by fold line 34, fold line 36, and gusset line 33. Adjacent triangular panel 6 circled is defined by fold line 36, vertical gusset fold line 33, and diagonal fold line 37. Panels 3, 6 and 7 circled mirror panels 2, 4 and 6 in the gusset 16 and gusset extension 20.

The preform 12 is partly expanded in FIG. 6, and the explanation of folding the extension and the upper portions of the gusset 16, which includes panels 6 and 7, will be clearer with reference to FIGS. 7, 8, 9, 10 and 11. Note initially that fold line 32, as seen in FIGS. 5 and 6, extends diagonally downwardly from upper edges 40 of the preform panels 13 and 14, so that fold line 36, as seen in FIG. 5, is substantially below the upper edges 40 of the panels 13 and 14.

It should be understood with reference to FIG. 6, that all of the encircled numbered panels 1 to 10 in FIG. 6, are in a vertical plane, as shown in that FIG., and that the fold lines 32, 33, 34, 35 and 36, are creased in a direction to facilitate the folding pattern described with reference to FIGS. 7, 8, 9, 10 and 11. The mechanism and mechanical element and the folding and creasing elements necessary to achieve these functions have individually been within the bag manufacture art for many years, but as of the present date, a completely automated machine for achieving this result, the fold lines, and the folding operations, has not been devised, but the description of these elements is adequately contained in this specification because the fold lines and folding can be produced manually.

Figure 7:
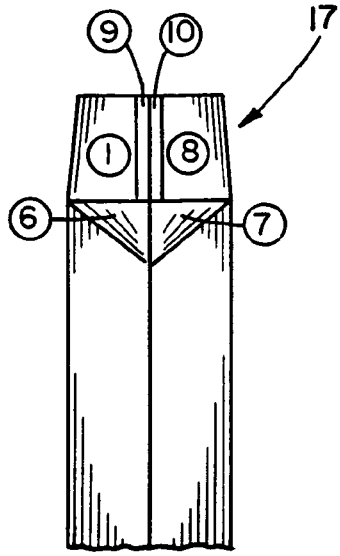
FIG. 7 is a downward side perspective from the right side of the partly expanded bag preform illustrating an intermediate position of the panels as they are folded inwardly into the bag.
Figure 8:
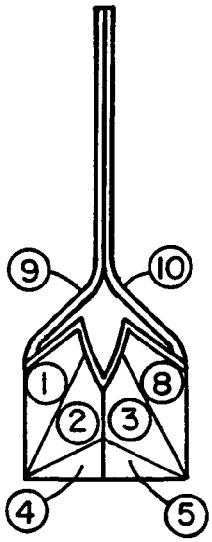
FIG. 8 is a fragmented right downward perspective illustrating the numbered panels of the extension and the corner of the preform below the extension folded further inwardly into the bag.

Referring to the sequence of folding the extension 17 shown in FIG. 6 into the valve 24 illustrated in FIGS. 2 and 11, will be described with reference to FIGS. 7, 8, 9 and 10. As seen initially in FIGS. 6, 7, 8 and 9, the extension beginning with fold line 33, is folded inwardly into the bag between the front panel 13 and the rear panel 14, as shown in FIG. 7, which is a right side view where the extension 17 is not as yet coplanar with the top edges 40 in the front panel 13 and the rear panel 14. In this position, the triangular panels 4 and 5, which were in the upper part of the gusset 16, have been folded inwardly and downwardly so that they are not visible from the right side view of FIG. 7, because they are behind the panels 6 and 7, as shown in FIG. 7. The same view is illustrated in FIG. 8, which is a top view where the panels 4 and 5 are now visible and they cover the panels 6 and 7 illustrated in FIG. 7. The panels 1 and 8, as shown in FIG. 8, begin to form a trough with the upper gusset panel portions 2 and 3.

Figure 9:
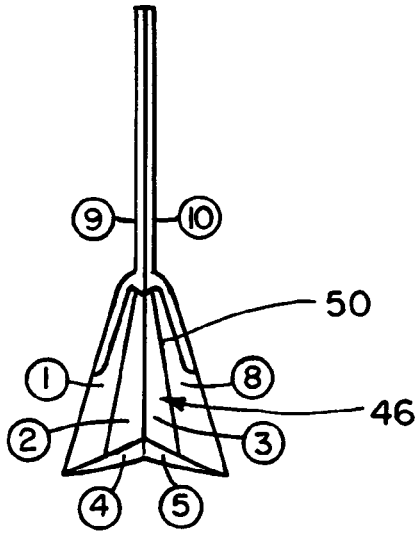
FIG. 9 is a top view of the positions of the panels as folded in FIG. 8.
Figure 10:
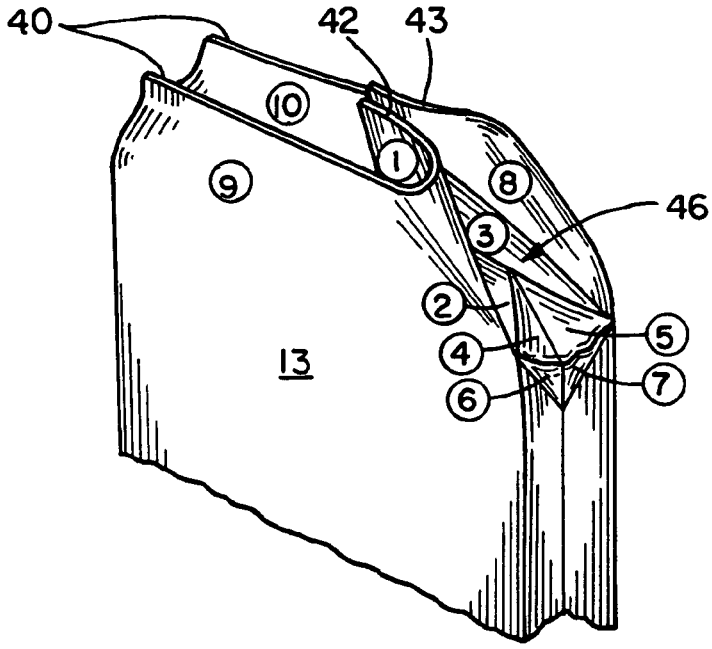
FIG. 10 is a top view with the panels folded further inwardly from the positions illustrated in FIG. 9.
Figure 11:
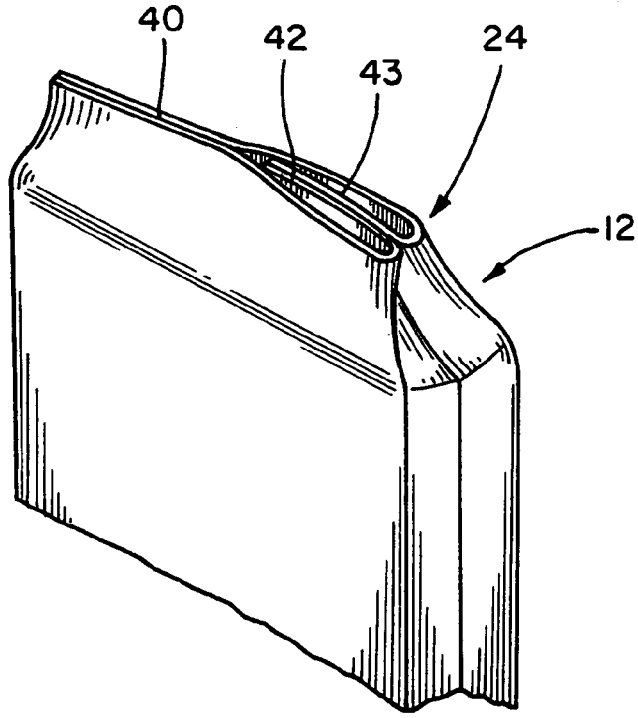
FIG. 11 is a top perspective with the panels folded to their final position before heat sealing.

Further lowering of the panels 1, 2, 3 and 8 into the bag is illustrated in FIGS. 9 and 10, where the vertical upper edge 42 of the encircled panel 1, and the vertical edge 43 in the panel 8 in the preform 12 rotate downwardly as shown in FIG. 10, toward a line co-linear with forward and rear panel upper edges 40 as shown in FIGS. 10 and 11.

This positions panels 1, 2 and 8 into a trough-like configuration defining a U-shaped panel 46 that will become the filling valve 24 when completed.

The upper edges 42 and 43 of the panels 1 and 8 are then brought together as shown in FIG. 11.

Figure 12:
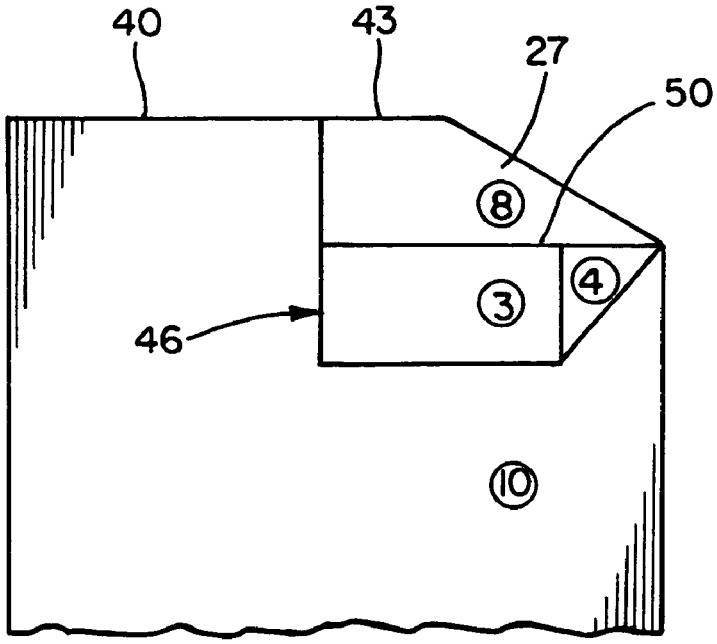
FIG. 12 is a front fragmentary plan view of the heat sealed completed bag with panel 9 fragmented away so that the filling tube can be seen.
Figure 13:
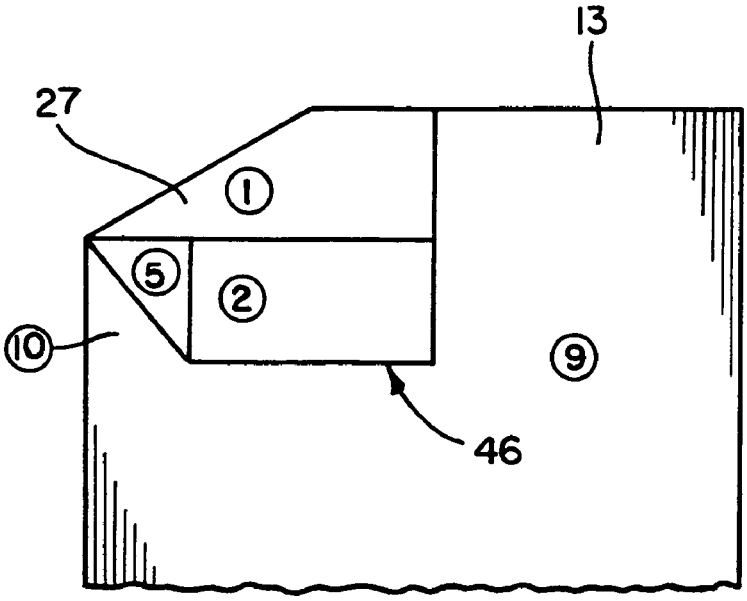
FIG. 13 is a reverse view of FIG. 12, illustrating a view looking forwardly of the corner of the bag with the opening of panel 10 removed; i.e., looking toward panel 9.

The configuration of the resulting filling panel 46 can be seen in FIGS. 12 and 13. In FIG. 12, which is a front view, the panel 13 has been removed to illustrate the filling panel 46, which consists of the panel 8, which has upper edge 43 co-linear with the upper edge 40 of panel 10, and panel 4 forming a gusset with panel 5 against panels 6 and 7. Gusset fold line 50 between panels 3 and 8 becomes irrelevant at this point because the filling panel 46 is simply a loop defined by panels 8, 3, 1 and 2.

As shown in FIG. 13, which is a view from the rear looking forward of bag 11 with the rear panel 10 removed, the preform filling tube panel is shown to include the panels 1 and 2, and the gusset panel 5, which seats over the top of and hides the gusset panel 7 shown in FIGS. 6 and 9.

The filling opening is referenced in FIGS. 12 and 13, again by the reference numeral 27 indicated in FIG. 4.

After the completion of the preform 12 illustrated in FIG. 11, the bag is heat-sealed at 30 as illustrated in FIGS. 1, 2 and 3, to complete the bag 11 as shown in FIG. 14, which is depicted in its filled condition.

FIG. 18 is a cross section taken generally along line 18—18 of FIG. 2 looking upwardly in the bag toward the valve 24. Note that the section of FIG. 18 is taken through the gusset formed by the collapsing of panels 4 and 5 against the interior surfaces of panels 6 and 7, and they are so depicted in FIG. 18. Since FIG. 18 is an upward view toward the bottom of the panel 46, the encircled numbered panels 2 and 3 are shown which hide the remaining portions of the filling panel 46 defined by panels 1 and 8 illustrated in FIGS. 12 and 13 respectively.

As seen in FIGS. 15 and 16, the present method is practiced by a web-fed continuous process, and the web 60 is illustrated in FIG. 16 very schematically and emanates from a tubular roll of thermoplastic material having the appropriate dimensional configurations. Thereafter, as the material is fed from the web, suitable folding bars (not shown) form the side gussets 15 and 16. Thereafter, the extension 17 is formed by cutting away the material illustrated at 62 in FIG. 15, thereby forming the preform 12 illustrated in FIG. 16, and also illustrated in FIG. 5. Thereafter, the various fold lines are formed during the folding process illustrated in sequence from FIG. 6 to FIGS. 7, 8, 9, 10 and 11, and thereafter, the heat-seal 30 is effected which not only heat-seals the upper edges 40 of front and rear panels 13 and 14, but also the upper edges 42 and 43 of the panels 1 and 8, completing the filling valve 24 in accordance with the present design.

What is claimed is:

1. A side gusseted poly bag with a filling valve, comprising: a tubular body constructed of a thermoplastic material having side gussets one on each side defining forward and rear main panels, said forward and rear panels being heat sealed together with the gussets along a top portion and a bottom portion of the poly bag except at one corner of the poly bag where the front panel is not connected to the rear panel defining a filling opening in the poly bag, a filling tube attached to the front and rear panels at the opening and extending into the bag interior along upper portions of the front and rear panels and heat sealed with the heat seal of the front and rear panels forming a tubular filling valve, said filling tube being formed integral with the bag by portions of the side gusset at said corner and substantial portions of the front rear panels without any separate pieces, said integral filling tube extending a substantial distance into the bag, said filling tube portions of the front and rear panel being heat sealed along the upper portions of the front and rear panels and heat sealed therewith to close the bag and form the filling valve.

2. A side gusseted poly bag with a filling valve as defined in claim 1, wherein the filling tube is positioned to rise toward and close the opening as material is charged into the bag through the filling tube.

3. A side gusseted poly bag with a filling valve as defined in claim 1, wherein the filling tube has a width of about 30% of the width of the forward and rear panels.

4. A side gusseted poly bag with a filling valve as defined in claim 1, wherein the gusset at the corner is folded downwardly into the bag interior against the remaining upper adjacent gusset forming an interior gusset defining a portion of the filling tube.

5. A side gusseted poly bag with a filling valve as defined in claim 1, wherein the upper portion of the filling tube is defined by portions of the forward and rear panels and the lower portion of the filling tube is defined by portions of the adjacent gusset.

6. A method for making a side gusseted poly bag with a filling valve, including the steps of: forming a tubular body of thermoplastic material having side gussets on each side defining forward and rear main panels, heat sealing the forward and rear panels together with the gussets along a top portion and a bottom portion of the poly bag except at one corner of the poly bag where the front panel is not connected to the rear panel defining a filling opening in the poly bag, forming a filling tube attached to the front and rear panels extending a substantial distance into the bag interior along upper portions of the front and rear panels solely by folding the gusset at the top of one side inwardly with substantial portions of the forward and rear panels so the edges of the forward and rear panels are co-linear with the proposed heat seal line at the top of the bag, and heat sealing the forward and rear panels together with the edges of the forward and rear panel portions along the proposed heat seal line except at one corner of the poly bag where the front panel is not connected to the rear panel defining a filling opening in the panel bag, and heat sealing the front and rear panels with the filling panel forming a tubular filling valve.

7. A method for making a side gusseted poly bag with a filling valve as defined in claim 6, wherein the heat seal line is below the extension of the front and rear panels prior to folding them inward into the bag to form the filling tube.

* * * * *